United States Patent [19]

Francovitch

[11] 4,455,804

[45] Jun. 26, 1984

[54] MEMBRANE ANCHOR

[75] Inventor: Thomas F. Francovitch, Columbia, Md.

[73] Assignee: Single-Ply Institute of America, Inc., Columbia, Md.

[21] Appl. No.: 350,180

[22] Filed: Feb. 19, 1982

[51] Int. Cl.[3] ..... E04B 1/38

[52] U.S. Cl. ..... 52/698; 52/512; 52/410; 411/542

[58] Field of Search ..... 52/698, 410, 461, 514, 52/512, 506, 509, 536; 411/371, 531, 542, 548; 405/259

[56] References Cited

U.S. PATENT DOCUMENTS

| | | | |
|---|---|---|---|
| 1,111,034 | 9/1914 | Robertson | 411/531 |
| 2,020,767 | 11/1935 | Bullis et al. | 411/542 X |
| 3,588,787 | 6/1971 | Kindell et al. | 411/531 |
| 3,918,233 | 11/1975 | Simpson | 52/536 X |
| 4,026,183 | 5/1977 | Bart | 411/542 |
| 4,037,418 | 7/1977 | Hannan | 405/259 |
| 4,074,501 | 2/1978 | Sandquist | 52/410 X |
| 4,102,239 | 7/1978 | Dallas | 441/531 |
| 4,361,997 | 12/1982 | De Caro | 52/698 X |

FOREIGN PATENT DOCUMENTS

| | | | |
|---|---|---|---|
| 2330901 | 6/1977 | France | 411/531 |
| 7415863 | 6/1976 | Netherlands | 411/545 |

*Primary Examiner*—J. Karl Bell

*Attorney, Agent, or Firm*—Irvin A. Lavine

[57] ABSTRACT

A membrane anchor comprises a disc of rubber-like material having a central opening and downwardly inclined upper and lower surfaces. The lower surface has grooves for receiving mastic.

19 Claims, 5 Drawing Figures

Fig. 1
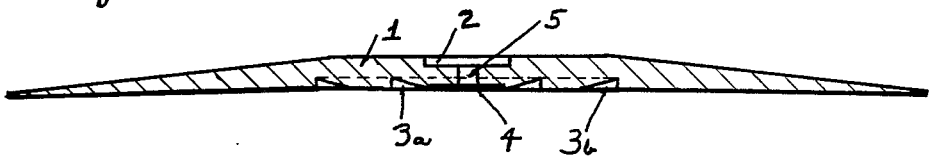
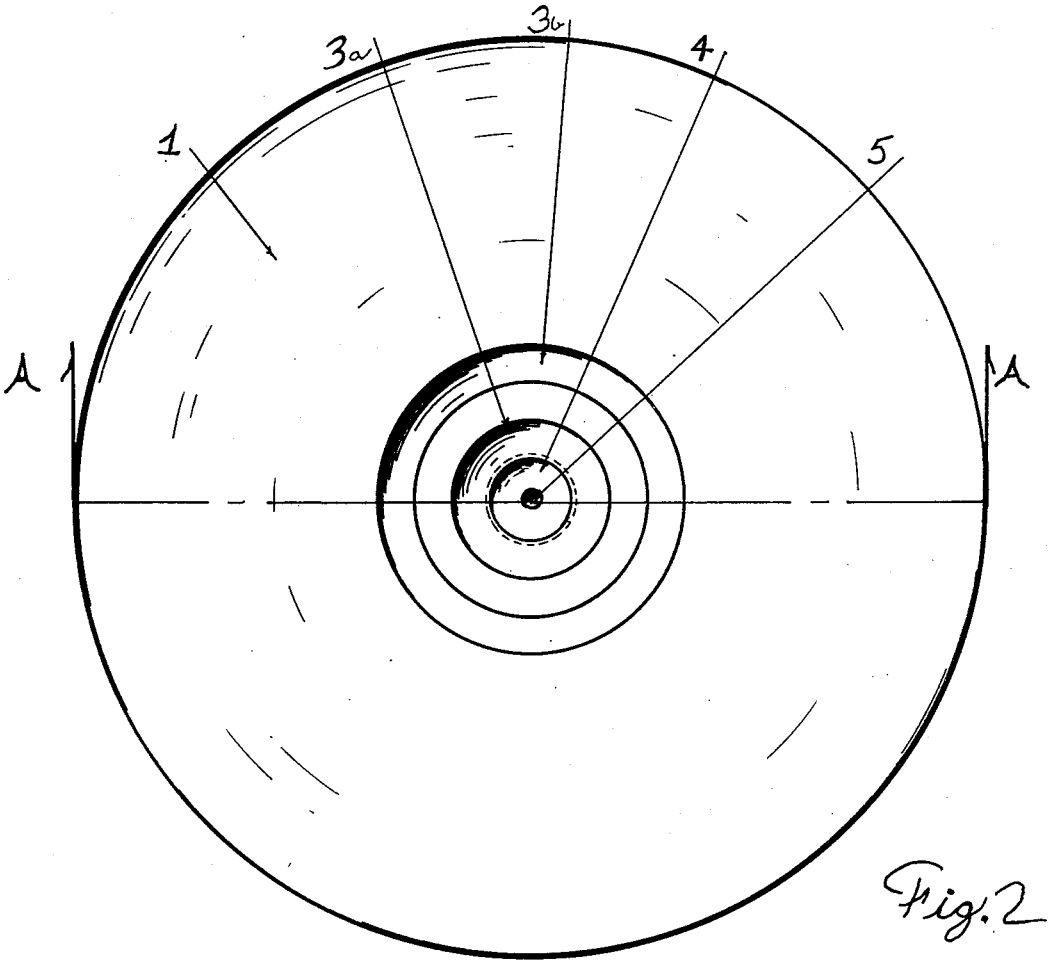
Fig. 2

MEMBRANE ANCHOR

TECHNICAL FIELD

The present invention relates to an anchor for membrane used as a roofing material to prevent moisture from entering a structure such as a building.

BACKGROUND ART

It is conventional to apply membranes to roofs in order to prevent the entry of moisture into the structure of which the roof forms a part. These membranes are made of a synthetic, rubber-like material which is flaccid and waterproof and typically are 3/64" thick; they are supplied in rolls of 100' length and vary in width from 4'6" to 45'.

There have been four systems utilized for fastening the membranes. In the adhered system, a suitable cement is applied to the substructure surface and the rubber-like membrane applied over it; there is an overlap of one membrane sheet with the next, so as to provide a water impervious lap joint. A partially adhered method or system is used, wherein the bonding of the membrane takes place at special plate areas or locations. The ballasted system involves the holding down of the membrane with a layer of small stones. There is also used a mechanically fastened system, in which battens or other strips are placed on the membrane and are adhered, with complex systems for connecting the batten and sealing it. The batten is a strip of rubber or plastic material and is utilized in order not only to hold the sheet down against wind forces which might tend to lift it (as do the other systems) but also prevents or retards creeping movement of the sheet due to expansion and contraction. The seal utilized with the batten strip is a small membrane sheet which entirely covers the batten strip and which is glued down over the entire strip. All of the foregoing systems suffered either from expense of installation, or expense of materials, or both.

DISCLOSURE OF INVENTION

The present invention is directed to an anchor for a membrane, such as a rubber or rubber-like membrane sheet applied over a roof substrate. The anchor comprises a disc of rubber or rubber-like material, being resilient and water impervious. The disc has a relatively thick central region and an outwardly tapering peripheral region. An axial opening is provided at the center of the disc, and the lower surface of the disc is provided with annular grooves in the central region. Recesses are provided in the upper and lower surfaces in surrounding relationship to the axial opening. The lower surface of the disc, in the unstressed state, is inclined upwardly from the edge of the disc, to the juncture of the central and peripheral regions. A linear fastener is passed through the opening, with its head located in the recess in the upper surface. Sealing material may be deposited over the head, to prevent entry of moisture, and sealing material is deposited in the grooves, prior to the application of the disc to the membrane, to form a barrier against the inward penetration of moisture.

BRIEF DESCRIPTION OF DRAWINGS

FIG. 1 is a cross-sectional view of a membrane anchor in accordance with the present invention, taken on the line A—A of FIG. 2.

FIG. 2 is a plan view of the membrane anchor of FIG. 1, showing the lower surface.

BEST MODE FOR CARRYING OUT THE INVENTION

Figure 3:
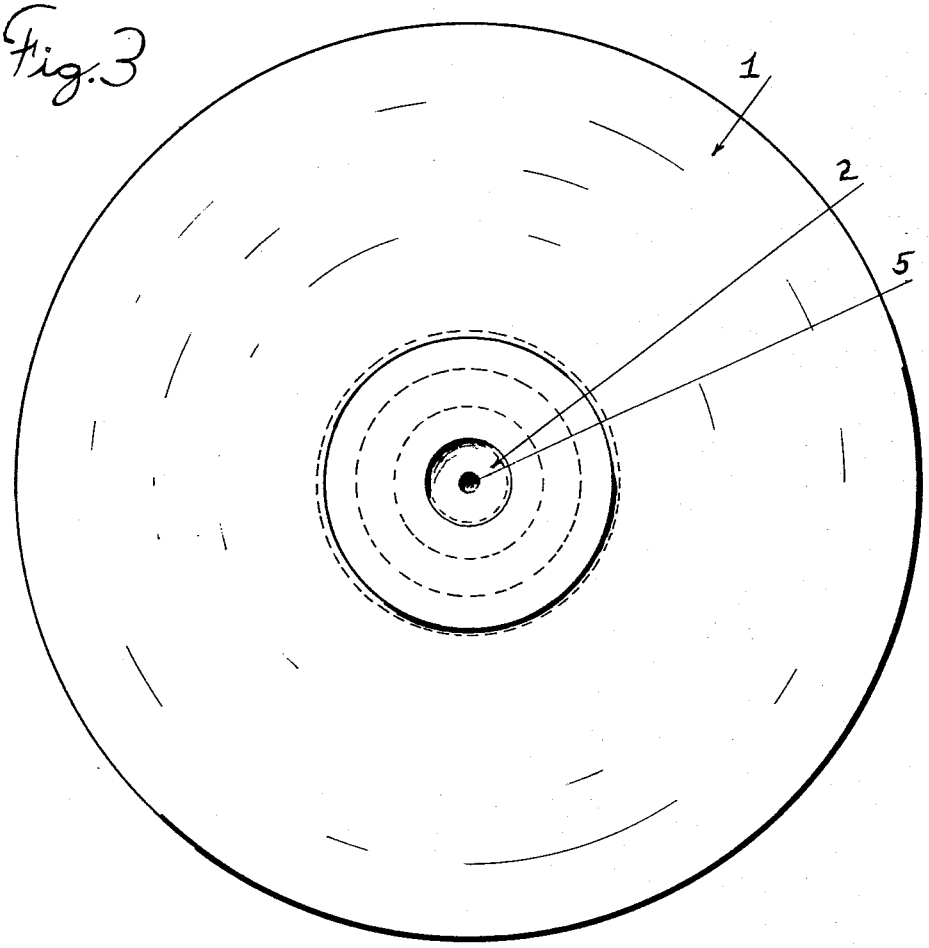
FIG. 3 is a plan view of the membrane anchor, showing the upper surface.

Referring now to the drawings, wherein like or corresponding references numerals are used to designate like or corresponding parts throughout the several views, there is shown in FIG. 1 a membrane anchor 1 of disc formation, and made of a resilient, water impervious material which is of a rubber or rubber-like substance. In the upper surface, located centrally, is a recess 2, and in the lower surface, there are a pair of annular grooves 3*a* and 3*b*. Extending axially through the center of the membrane anchor 1 is an opening 5 which communicates with the recesses 2 and 4.

FIG. 2 clearly shows the concentric annular grooves 3*a* and 3*b* on the lower surface of the membrane anchor 1, the recess 4 and the opening 5, while FIG. 3 clearly discloses the opening 5 and recess 2 in the upper surface.

Figure 4:
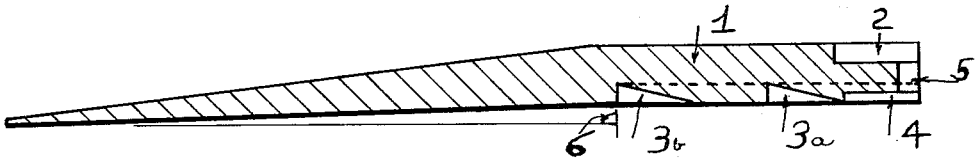
FIG. 4 is an enlarged view of one half of the membrane anchor as shown in FIG. 1.

As shown in FIG. 4, the membrane anchor 1 has a central region which is of uniform thickness, and it is in this region that the continuous annular grooves 3*a* and 3*b* are located, as well as the opening 5 and the surrounding recesses 2 and 4. The membrane anchor 1, adjacent and outwardly of the thicker central region, has a peripheral region which is of outwardly tapering thickness, the upper surface of the outer region being inclined downwardly towards the edge of the membrane anchor or disc 1, while the lower surface is inclined upwardly from the edge of the disc, when the disc is not stressed, to the juncture of the two regions. The angle of upward inclination is indicated by reference numerals 6 and will be seen to be a slight angle of a few degrees. The peripheral region is of substantially the same thickness as the central region at the juncture between them.

Figure 5:
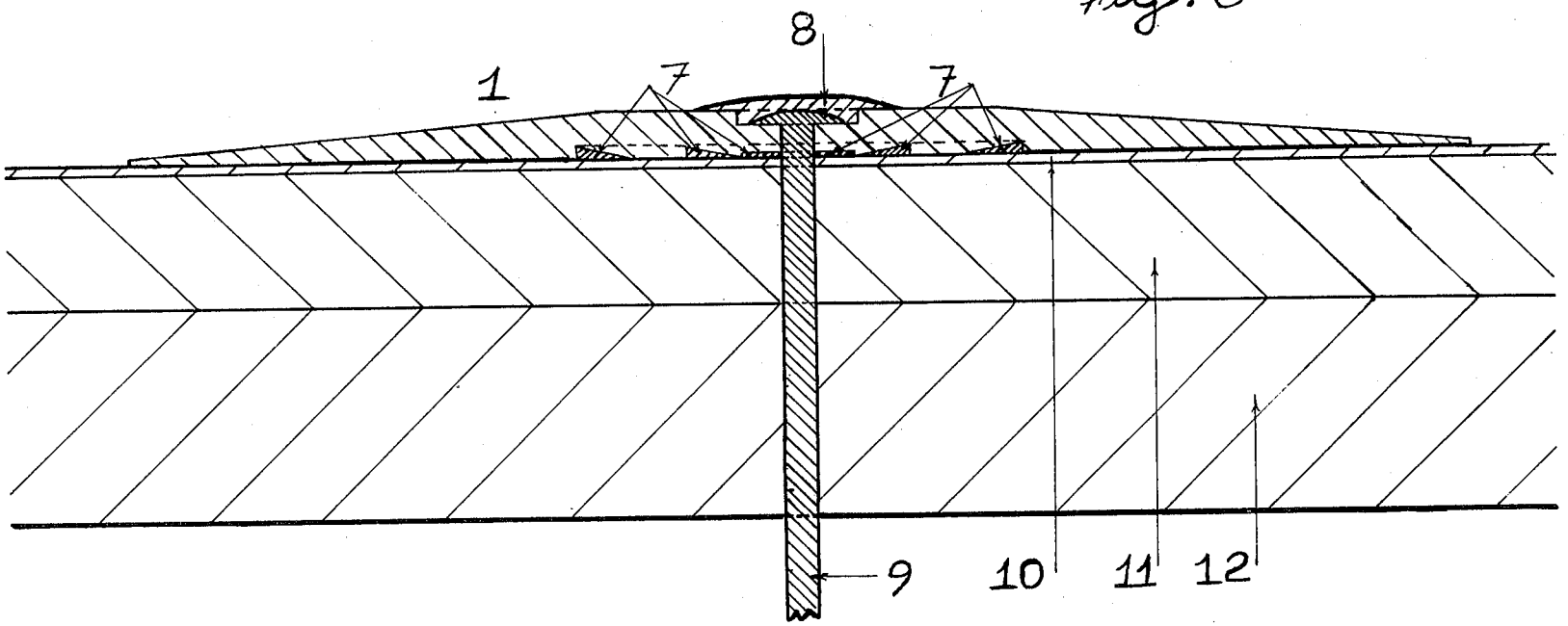
FIG. 5 is a cross-sectional view showing a membrane anchor installed.

Referring to FIG. 5, there is shown the membrane anchor in installed position, in place on and engaging a membrane 10, which is supported by any conventional substrate member or members 11 and 12. A linear fastener 9 extends through the opening 5, and is of a type suitable for the particular substrate with which the membrane 10 is used. The head of the linear fastener 9 is in the upper recess, and a mass of sealing material is placed over the head of fastener 9, in engagement with the head of fastener 9 and the membrane anchor or disc 1. Prior to placing the membrane anchor or disc 1 against membrane 10, sealing material, such as mastic, generally designated by the numeral 7, will have been placed in the annular grooves.

To use the membrane anchor of the present invention, mastic or other sealing material is applied so as to fill the annular grooves, and then the membrane anchor is placed in position, engaging the membrane 10. The linear fastener 9 is then put in place: if it is a nail, it is driven in place, or it may by a type of blind fastener or screw fastener, depending upon the material of the substrate. There results a pushing downwardly of the central region, causing it to bear with substantial pressure against the membrane 10. This causes the mastic or sealing material 7 to flow outwardly, spreading to a certain extend outwardly towards the disc edge, thereby providing a seal against the entry of moisture towards the fastener 9. In addition, there is deflection of the peripheral region, due to the angle of inclination 6 of the lower surface and the resilient quality of the membrane anchor 1, thereby providing a hold down force over a very substantial area by the membrane anchor 1. Thereafter, the sealant mass 8 is applied, to prevent entry of moisture at the head of fastener 9.

The membrane anchors as shown in FIG. 5 may be applied at spaced locations, such as on four-foot centers. As a result, the herein disclosed membrane anchor and related elements provide a system which is economical to manufacture and economical to install, while providing great hold down characteristics for the membrane and, also, preventing the entry of moisture.

I claim:

1. A membrane anchor comprising a resilient, water-impervious disc of rubber-like material having upper and lower surfaces, an axial opening at the center of said disc, said disc having a central region of substantially uniform thickness and a peripheral region of tapering thickness adjacent to and outwardly of said central region, said peripheral region being of substantially the same thickness as said central region at the juncture of said regions, said lower surface of said disc at said central region being substantially planar and having continuous groove means therein about said opening for receiving sealing material.

2. The membrane anchor of claim 1, and a recess in the upper surface of said disc surrounding said opening.

3. The membrane anchor of claim 1 or 2, and a recess in the lower surface of said disc surrounding said opening.

4. The membrane anchor of claim 1, said peripheral region being of outwardly tapering thickness.

5. The membrane anchor of claim 4, wherein the upper surface of the outer region is inclined downwardly towards the edge of the disc.

6. The membrane anchor of claim 1 wherein the lower surface is inclined upwardly from the edge of the disc when the disc is not stressed.

7. The membrane anchor of claim 6, wherein the lower surface is inclined upwardly from the disc edge to the juncture of said regions.

8. The membrane anchor of claim 1, and a linear fastener extending through said opening and having a head engaging said disc.

9. The structure of claim 8, said disc having a recess in the upper surface surrounding said opening, and said fastener head located in said recess.

10. The structure of claim 9, and means for sealing said opening.

11. The structure of claim 10, said sealing means comprising a mass of sealing material engaging said head and adjacent parts of said disc.

12. The structure of claim 8, a membrane engaged by substantially the entire disc lower surface, and means for preventing penetration of moisture to the center of said disc.

13. The structure of claim 12, last said mentioned means comprising sealing material in said groove means and engaging said membrane.

14. The membrane anchor of claim 4, wherein the lower surface is inclined upwardly from the edge of the disc when the disc is not stressed.

15. The membrane anchor of claim 1, wherein the lower surface is inclined upwardly from the disc edge to the juncture of said regions.

16. The structure of claim 11, a membrane engaged by substantially the entire disc lower surface, and means for preventing penetration of moisture to the center of said disc.

17. The structure of claim 16, said last mentioned means comprising sealing material in said groove means and engaging said membrane.

18. The structure of claim 17, said disc being secured to said membrane only by said linear fastener.

19. The structure of claim 9, a membrane engaged by substantially the entire disc lower surface, and means for preventing penetration of moisture to the center of said disc.

* * * * *